United States Patent [19]

Gallmeyer

[11] 4,247,101

[45] Jan. 27, 1981

[54] WEIGHTED ARM BAND FOR BOWLERS

[76] Inventor: Richard R. Gallmeyer, 142 Poultney St., Buffalo, N.Y. 14215

[21] Appl. No.: 966,055

[22] Filed: Dec. 4, 1978

[51] Int. Cl.[3] ..... A63B 71/04; A63B 23/00

[52] U.S. Cl. ..... 273/54 B; 272/119

[58] Field of Search ..... 273/54 B; 272/67, 119; 128/DIG. 15

[56] References Cited

U.S. PATENT DOCUMENTS

| | | | |
|---|---|---|---|
| D. 200,415 | 2/1965 | Tarbox | 272/67 UX |
| 1,729,209 | 9/1929 | Curtice | 272/119 |
| 3,124,806 | 3/1964 | Campbell | 273/54 B UX |
| 3,149,839 | 9/1964 | Materia | 273/54 B |
| 3,535,718 | 10/1970 | Murcott | 128/DIG. 15 X |
| 3,606,342 | 9/1971 | Albertson | 273/54 B X |
| 3,779,550 | 12/1973 | Benoun et al. | 273/54 B |

*Primary Examiner*—Anton O. Oechsle

*Attorney, Agent, or Firm*—Christel, Bean & Linihan

[57] ABSTRACT

A device for improving motion, extension and control of an arm of a person playing a game such as bowling comprising a band of flexible material having an inner surface which is in firm contact with the arm of the person in the area of the wrist and above the hand when the device is worn during use and having an oppositely-directed outer surface. A weight is fixedly held on the outer surface of the band and comprises a quantity of closely-packed metal pellets within a flexible container. A pair of loop-like elements are fixed in spaced relation to the band along one end thereof, and a pair of flexible straps extend in spaced-apart, generally parallel relation outwardly from the opposite end of the band. Each of the straps is provided with a fastener on the outer surface thereof, and a pair of mating fasteners is provided on the outer surface of the band. When the device is worn for use each of the straps extends from the end of the band laterally along the surface of the person's arm, extends through a corresponding one of the loops, and then is returned back past the end of the band to be in mating engagement with the fastener on the band, each strap serving to draw the band tightly against the surface of the person's arm.

7 Claims, 5 Drawing Figures

Fig. 1.
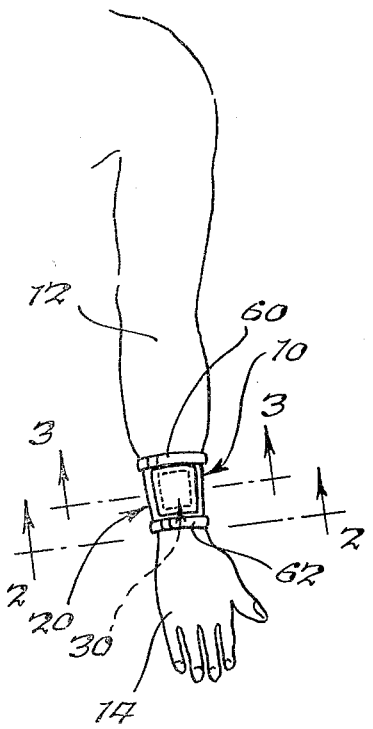
Fig. 2.
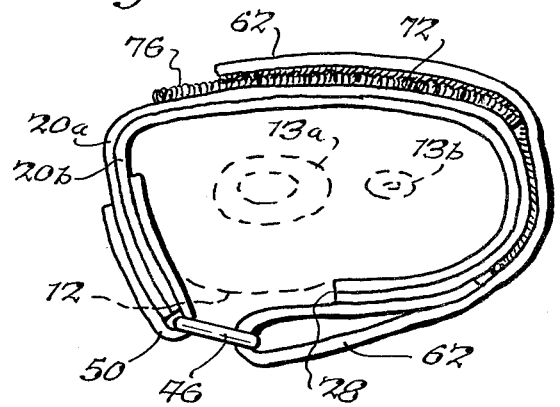
Fig. 3.
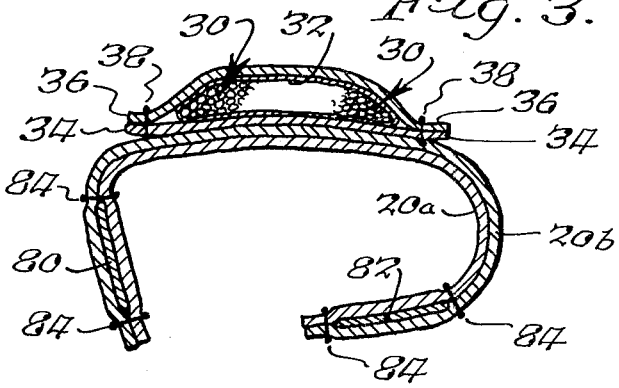
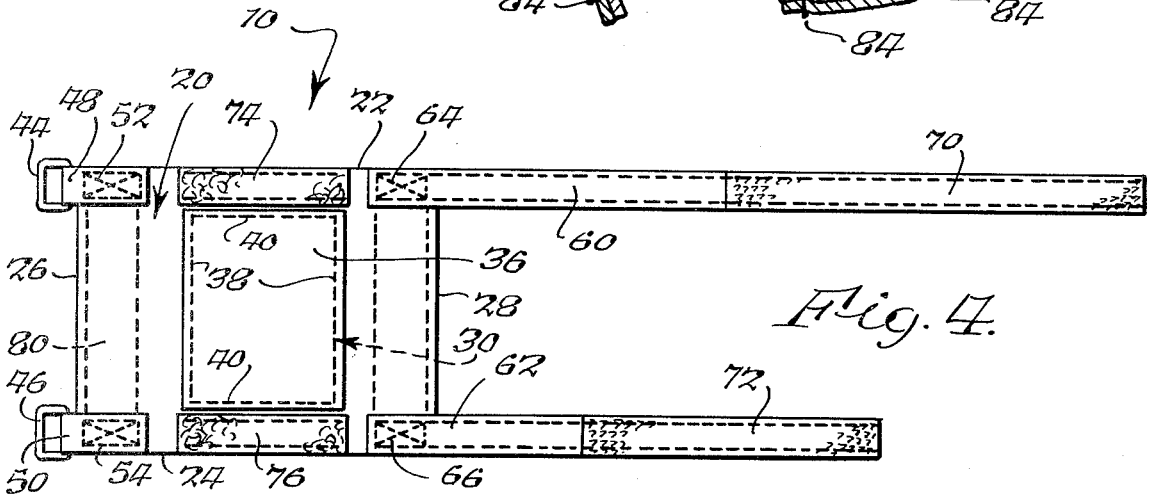
Fig. 4.
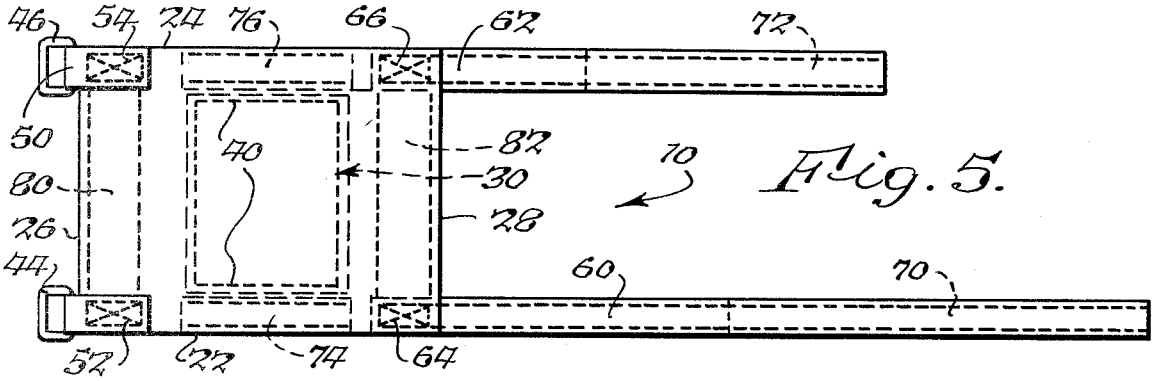
Fig. 5.

WEIGHTED ARM BAND FOR BOWLERS

BACKGROUND OF THE INVENTION

This invention relates to the art of athletic goods, and more particularly to a new and improved device for improving the motion, extension and control of the arm of a person playing a game such as bowling.

One area of use of the present invention is in the game of bowling, although the principles of the present invention can be variously applied. In games such as bowling, the arm action of the player is of primary importance. For example, as the player swings his arms during delivery of the bowling ball he must control the swing, try for full extension of the arm, keep any turning action on the ball under control and avoid over-turning, release the ball properly and try for a good follow-through. The foregoing obviously requires much practice and concentration by the player. It would, therefore, be highly desirable to provide a device worn on the arm of a bowler for improving the motion, extension and control of the bowler's arm.

SUMMARY OF THE INVENTION

It is, therefore, a primary object of this invention to provide a new and improved device for improving the motion, extension and control of the arm of a person playing a game such as bowling.

It is a more particular object of this invention to provide such a device which enhances the pendulum-like motion of the person's arm when carrying and delivering a bowling ball during the game.

It is a more particular object of this invention to provide such a device which encourages a full extension of the person's arm when carrying and delivering a bowling ball during the game.

It is a more particular object of this invention to provide such a device which controls the amount of turning of the ball during the bowler's arm swing.

It is a further object of this invention to provide such a device which is comfortable to wear, simple in construction and economical to manufacture.

The present invention provides a device for improving the motion, extension and control of the arm of a person playing a game such as bowling comprising a band of flexible material of generally rectangular shape and having an inner surface which is in firm contact with the arm of the person in the area of the wrist and above the hand when the device is in use and an oppositely-directed outer surface, and a weight held on the outer surface of the band in fixed relation thereto and being of sufficient magnitude so as to improve the arm action of the person by enhancing the arm motion, causing fuller extension of the arm and providing control of arm movements. A pair of loop elements are fixed to the band in space relation along one end edge thereof, and a pair of flexible straps is fixed to the band at the opposite end thereof, the straps extending therefrom in spaced relation. There is provided fastening means on each of the straps and mating fastening means on the outer surface of the band in general longitudinal alignment with the fastening means on the straps. When the device is in use each of the straps extends from the end edge of the band along the surface of the person's arm and laterally of the arm and extends further through a corresponding one of the loops and then returns back past the end edge to the region of the corresponding one of the mating fastening means. As a result, each strap draws the band tightly against the surface of the person's arm and is held firmly in place by engagement between the fastening means on the strap and the corresponding one of the mating fastening means on the band.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a fragmentary elevational view showing the weighted arm band of the present invention as it would appear when worn in place on the arm of a person playing a game such as bowling;

FIG. 2 is an end view of the weighted arm band taken about on line 2—2 in FIG. 1 and showing the person's arm and arm bones in broken lines;

FIG. 3 is a sectional view taken about on line 3—3 in FIG. 1;

FIG. 4 is a plan view of the weighted arm band of the present invention taken from the outer surface to which the weight is attached; and FIG. 5 is a plan view of the weighted arm band of the present invention taken from the opposite surface of the band.

DETAILED DESCRIPTION OF THE ILLUSTRATED EMBODIMENT

Referring now to FIG. 1, there is shown a device generally designated 10 according to the present invention for improving the motion, extension and control of the arm of a person playing a game such as bowling. The device 10 is shown in FIG. 1 in a position of use, releasably fastened to the arm 12 of the user, and located on the arm in the area of the wrist and above the users hand 14.

Referring now in detail to FIGS. 2–5, the device 10 comprises a band 20 of flexible material having a generally rectangular shape including spaced-apart substantially parallel side edges 22,24 and space-apart substantially parallel end edges 26 and 28. The material of band 20 should provide sufficient flexibility to comfortably conform to the outer surface of the arm of the user and at the same time have a significant degree of strength. For example, various hides, natural or synthetic, and leather can be employed but other suitable materials can be used. By way of example, one material found to perform well is the synthetic material known commercially as Naugahide. Band 20 has a thickness many times smaller than the length and width thereof as illustrated further in FIGS. 2 and 3. The band 20 has an inner surface, and when the device is in use this surface is in firm contact with the arm 12 of the person in the area of the wrist and above the hand 14. The band also includes an oppositely directed outer surface. Band 20 preferably comprises two sheets **20*a*,20*b* of material secured together, for example by stitching, about the peripheral edges so as to be of a laminated construction. According to a preferred mode of the present invention, band 20 preferably has a length measured along either edge 22 or 24 of about $5\frac{7}{8}$ inches, a width measured along either edge 26 or 28 of about $4\frac{3}{4}$ inches and a thickness of about one-eighth inch. Other sizes are well as materials and construction of the band 20** can of course be employed.

The device 10 of the present invention further comprises a weight 30 of sufficient magnitude so as to improve the arm action of the person wearing the device by enhancing the arm motion, causing fuller extension of the arm and providing control of arm movements. The device 10 also includes means for holding the weight 30 on the outer surface of band 20 in fixed relation thereto. In particular, as shown in detail in FIG. 3, weight 30 comprises a quantity of metal pellets such as metal shot, lead pellets or metal particles of the size commonly used in air guns and the like. The pellets or particles are housed in a container in relatively closely packed relation as shown in FIG. 3. The weight holding means comprises a first container 32 of flexible material having a generally rectangular perimeter and enclosing the quantity of pellets 30. The container 32 is of relatively thin-walled construction, and container 32 conveniently can be in the form of a flat thin-walled plastic bag or pouch which is heat sealed, sewn or otherwise closed around the periphery thereof after having been filled with the pellets 30.

The weight holding means further comprises a second container of flexible material having a generally rectangular perimeter and enclosing the first container 32. The two containers are in relatively close fitting relation, and the second container has a thickness greater than the thickness of the first container 32 as illustrated in FIG. 3. The second container is disposed on the outer surface of the band 20 with the edges of the container being substantially parallel to the neighboring or corresponding edges of the band 20. As shown in detail in FIG. 3, the second container is defined by a first substantially rectangular sheet 34 of flexible material in contact with the outer surface of band 20 and a second sheet of flexible material 34 having substantially the same dimensions as sheet 34. The two sheets 34,36 house the weight 30 and container 32 therebetween with the inner surfaces of the sheets 34,36 contacting opposite outer surfaces of the container 32. The sheets 34 and 36, which can be of the same material as band 20, are secured together around the periphery by stitching 38 or the equivalent. There is also provided means for securing the second container to band 20 along the two opposite edges of the second container which are disposed generally parallel to the side edges 22 and 24 of the band 20. The securing means can be of any suitable form, and it is preferred that this be provided by stitching designated 40 in FIGS. 4 and 5.

The device 10 according to the present invention further comprises a pair of loop elements 44 and 46 fixed to band 20 in spaced-apart relation along one of the end edges of the band. In the device shown, the loops or rings 44,46 are located along the edge 26 as shown in FIGS. 4 and 5. The loops 44,46 preferably are of metal having a generally rectangular perimeter, and they are located also adjacent corresponding ones of the side edges 22,24 of band 20. In particular as shown in FIG. 4, loop 44 is located adjacent the corner defined by the side edge 22 and end edge 26 with one side or leg of the loop 44 being substantially coincident with the edge 22. Similarly, loop 46 is located adjacent the corner defined by side edge 24 and end edge 26 with one side or leg of the loop 46 being substantially coincident with the side edge 24. The loops 44,46 can be fixed to band 20 by various suitable arrangements and in the device shown this is accomplished by the relatively narrow band-like elements 48,50 which are secured to band by stitching 52 and 54 respectively. In particular, each of the bands or strips 48 and 50, which can be of the same material as band 20, is secured to both the inner and outer surfaces of band 20 with one edge of the strip or band being substantially coincident with the corresponding side edge 22,24. Each of the strips or bands extends outwardly from the end edge 26 a short distance and then returns so as to provide a space to receive and hold a leg or section of the corresponding loop 44,46.

The device 10 further comprises a pair of elongated straps 60,62 of flexible material each being fixed at one end thereof to the band 20 in spaced-apart relation along the other end edge 28. The straps 60,62 can be of the same material as band 20 and are secured such as by stitching 64,66 to band 20 adjacent the edge 28. The straps 60,62 are located relative to edge 28 so as to be in general longitudinal alignment with the loops 44,46 located along the opposite edge 26. The straps 60,62 extend outwardly from edge 28 in generally parallel relation to the side edges 22,24 and preferably the straps 60,62 are located adjacent corresponding ones of the side edges of the band. In particular, strap 60 is secured at one end to band 20 adjacent the corner defined by the junction of side edge 22 and end edge 28. Similarly, strap 62 is secured at one end to band 20 adjacent the corner defined by the junction between end edge 28 and the opposite side edge 24. Each of the straps 60,62 as shown in FIGS. 4 and 5 is relatively small in width compared to the length thereof. In addition, the straps 60,62 are of unequal length, and in the device shown strap 60 is of greater length than strap 62. The strap 60 which is of greater length is the strap which is located farthest from the person's hand when the device is in a position of use. By way of example, in an illustrative device, strap 60 has a length of about $12\frac{1}{4}$ inches measured from edge 28 to the outer end of strap 60 and has a width of about five-eights inch. Strap 62 has a length of about $7\frac{1}{2}$ inches measured from edge 28 to the outer end of strap 62 and has a width of about five-eighths inch.

The device 10 according to the present invention further comprises fastening means on each of the straps 60 and 62, each of the fastening means being on the surface of the corresponding one of the straps which faces in the same direction as the outer surface of the band 20 when the band and the straps lie in substantially the same plane, for example as shown in FIG. 4. The device further comprises mating fastening means on the outer surface of the band 20 in general longitudinal alignment with the fastening means on the straps. In particular, band 60 is provided with fastening means in the form of a length or tape 70 of a Velcro type fastening element. In particular the preferred fastening means is the plastic hook and loop tape type fastener available under the registered trademark Velcro of American Velcro, Inc. Tape 70 is approximately the same width as that of strap 60 and extends from the outermost end of strap 60 along a major portion of the length of strap 60, for example up to about two-thirds of the length of strap 60. Similarly, a Velcro type tape fastener 72 is provided on the surface of strap 62, extending from the outer end thereof along a major portion of the length thereof. The fasteners 70,72 are secured to the straps 60 and 62 respectively, by suitable means as stitching, adhesives or the like. The mating fastening elements on band 20 comprise tapes or strips 74,76 as shown in FIG. 4. Tape 74 is of Velcro material mating with respect to tape 70, and tape 74 is secured to the outer surface of band 20 between the side edge 22 of band 200 and the outer edge of the weight 30 and holding means adjacent the stitching 40. Tape 74 extends along the length of band 20 for a distance about equal to the corresponding edge of the weight and holding means. Strip 74 is secured to band 20 by suitable means such as stitching or adhesives. Thus, the strip 74 is in longitudinal alignment with the strip 70 on strap 60. In a similar manner, a length or strip of Velcro material 76 is provided on the outer surface of band 20 between the opposite end of the holding means and weight structure and the side edge 24 of band 20. The Velcro material of strip 76 is mating with respect to the material of strip 72. Strip 76 has a length approximately equal to the adjacent edge of the weight and holding means structure, is in longitudianl alignment with strip 72 on strap 62, and is secured to the surface of band 20 by adhesives, stitching or other suitable means. As shown in FIG. 4, the lengths of the fastening means 70 and 72 on the straps are greater than the length of the fastening means 74 and 76 on the band 20 to accommodate the different arm sizes of various persons in a manner which will be described.

The device 10 of the present invention further comprises a pair of elongated stiffening elements being fixed to the band 20 adjacent to and generally parallel to a corresponding one of the end edges 26 and 28. Each of the stiffening elements is generally rectangular in shape, having a length substantially equal to the width of band 20 and having a width considerably smaller than the length thereof. The stiffening elements preferably are of cardboard material but others such as plastic or metal could be employed. The stiffening elements are inserted between the laminations **20*a*,20*b* of the band 20 and secured therein by stitching designated 84 in FIG. 3. The stiffening elements are relatively thin as shown in FIG. 3, each having a thickness slightly smaller than one of the laminations 20*a*,20*b* of the band 20**.

The device 10 of the present invention operates in the following manner. The device is worn on the arm of a person playing a game such as bowling where the arm action of the player is of primary importance. The device 10 is located on the arm in the area or region of the wrist, and is located above the hand of the person as shown in FIG. 1. For example, in playing the game of bowling the person wears the device 10 on the arm which is used to carry and release the bowling ball. The device is installed on the arm in the following manner. The portion of the device including band 20 and the weight 30 is placed on the outer surface of the person's arm above the hand with the weight 30 and holding means facing outwardly, i.e. the smooth inner surface of band 20 is in contact with the outer surface of the arm. The band 20 is orientated or disposed on the arm with the end edges 26,28 extending generally parallel to the longitudinal axis of the arm. In other words, the side edges 22,24 of the band 20 will extend generally laterally around the person's arm. The device commonly is worn with the band 20 and weight 30 on the portion of the arm which faces outwardly or away from the person's body as shown in FIG. 1. Then the band is manipulated easily by the other hand of the person so as to be wrapped around the arm of the person. The straps 60 and 62 are extended around along the remaining surface of the arm whereupon each is inserted through a corresponding one of the loop elements 44,46 and then pulled backwardly, i.e. in a return direction along the arm and over the other portion of the strap as shown in FIG. 2. Then the fastening elements 70 and 72 on the straps 60 and 62 are moved into engagement with the mating fastening elements 74 and 76, respectively, on the outer surface of the band 20. During return of the straps back to the outer surface of the band 20 containing the mating fastening elements, the straps are drawn or pulled so as to make the band and straps tight on the arm of the person. This is further illustrated in FIG. 2 wherein band 20 is wrapped tightly around the arm of the person, the drawing also showing the bones **13*a*,13*b* of the person's arm for further illustration. Strap 62 extends from the end edge of the band 20 along the remaining exposed surface of the person's arm 12 whereupon it enters the loop or ring 46 and then is in effect bent back or returned upon itself and past the end edge 28 to the region of the corresponding one of the mating fastening elements 76 and is engaged therewith. In particular, the fastening tape 72 on strap 62 is in mating engagement with the strap 76 on the outer surface of band 20. The foregoing also is performed with strap 60 in a similar manner. The result is that each strap draws the band 20 tightly against the surface of the person's arm and is held firmly in place by engagement between the mating fastening element on the strap and band 20**.

The device 20 is oriented so that the longer strap 60 is facing the upper portion of the arm, i.e. the portion furthest from the hand, for greater comfort and effective holding of the device in view of the increasing diameter or size of the arm in a direction proceeding away from the hand. In addition, the fact that the fastening tapes 70 and 72 on straps 60 and 62, respectively, are of greater length than the tape fastener portions on the band 20 allows for accommodation of different sized arms of various persons.

In use, the device 10 is worn on the arm in the region of the wrist above the hand and typically on the outwardly facing surface of the arm as shown in FIG. 1. In bowling the device improves the motion of the arm on which it is worn and enhances the pendulum-like motion of the arm carrying the ball, both of which are desirable. The device with the weight 30 promotes and encourages a full extension of the arm carrying the ball. From the beginning through the middle portion of the person's arm swing wherein the ball is moved in a downward direction, the pellets comprising the weight 30 compress or concentrate under the influence of gravity and centrifugal force during this downward portion of the swing. This has the effect of adding or enhancing to a stretching or pulling like feeling or effect on the person's arm during the swing. The weight 30 can be provided in various sizes, typically 8, 10 and 12 oz. weights or packages thereof. The particular magnitude of the weight 30 generally is a function of the size of the person, from the standpoint of comfort and balance, and also the weight of the bowling ball.

Related to the foregoing is the fact that in improving the arm motion and enhancing the full extension of the arm this will promote easier release of the bowling ball from the hand at the appropriate point in the swing. Also, the weight serves to increase control of the arm swing and promotes the pendulum-like action of the arm and followthrough as described hereinabove. Typically, the device is worn on the outwardly facing surface of the arm as shown in FIG. 1 in which case this will have the effect of preventing any unwanted turning of the ball during the arm swing. If desired, however, the device 10 can be worn on the opposite surface of the arm, i.e. that portion facing inwardly toward the person's body, in which case this will enable the person to increase the turn of the ball during the stroke of the arm if this is desired.

Another advantage of providing weight 30 in the form of the pellets is that it increases the comfort of the device on the person's arm. The weight in the form of the pellets is more easily conformable through the tightening of the band to the shape or contour of the outer surface of the person's arm. The stiffeners 80 and 82 serve to add rigidity to the end portion of the band 20 and serve as a firmer, providing more comfort and a certain amount of wrist support. All of the foregoing are provided in a device which is simple in construction and easy to manufacture.

It is therefore apparent that the present invention accomplishes its intended objects. While a single embodiment of the invention has been described in detail, this is for the purpose of illustration and not limitation.

I claim:

1. A device for improving the motion, extension and control of the arm of a person playing a game such as bowling comprising:

(a) a band of flexible material having a generally rectangular shape including spaced-apart substantially parallel side edges and spaced-apart substantially parallel end edges, said band having a thickness many times smaller than the length and width thereof, said band having an inner surface which is in firm contact with the arm of the person in the area of the of the wrist and above the hand when said device is in use and an oppositely-directed outer surface, said band being worn on the arm carrying the ball;

(b) a weight of sufficient magnitude so as to improve the arm action of the person by enhancing the arm motion, causing fuller extension of the arm and providing control of arm movements;

(c) means for holding said weight on said outer surface of said band in fixed relation thereto and at a location on only the outwardly or inwardly facing surface of the person's arm;

(d) a pair of loops fixed to said band in spaced-apart relation along one of said end edges and located adjacent corresponding ones of said side edges of said band;

(e) a pair of straps of flexible material, each fixed at one end thereof to said band in spaced-apart relation along the other of said end edges and located adjacent corresponding ones of said side edges of said band, said straps extending outwardly from said end edge in generally parallel relation to said side edges, said straps being of unequal lengths, the one of said straps being located farthest from the person's hand having the greater length;

(f) fastening means on each of said straps, each of said fastening means being on the surface of the corresponding one of said straps which face in the same direction as said outer surface of said band when said band and said strap lie in substantially the same plane;

(g) mating fastening means on said outer surface of said band in general longitudinal alignment with said fastening means on said straps, said mating fastening means being located adjacent corresponding ones of said side edges of said band and extending between said end edges of said band;

(h) said fastening means on said straps and said mating fastening means on said band comprising plastic hook and loop tape type fasteners;

(i) each of said straps extending from said end edge of said band along the surface of the person's arm and laterally of the arm and further extending through the corresponding one of said loops and then returning back past said end edge to the region of the corresponding one of said mating fastening means whereby each strap draws said band tightly against the surface of the person's arm and is held firmly in place by engagement between the fastening means on said strap and the corresponding one of said mating fastening means; and (j) said weight comprising a quantity of metal pellets and said holding means comprising a container for said pellets, said container being of a size in a direction generally parallel to said side eges of said arm band such that said container extends along a major portion of the surface portion of the person's arm contacted by said band, there being a plurality of pellets in said container located in directions generally parallel to said band side edges and generally parallel to said band end edges and in a direction generally normal to said band outer surface, said pellets being concentrated in said quantity under influence of gravity and centrifugal force during a downward swing portion of the person's arm motion.

2. A device according to claim 1, wherein said fastening means on said band are of substantially equal lengths and wherein said fastening means on said straps each have a length greater than the corresponding mating fastening element on said band for accommodating different arm sizes.

3. A device for improving the motion, extension and control of the arm of a person playing a game such as bowling comprising:

(a) a band of flexible material having a generally rectangular shape including spaced-apart substantially parallel side edges and spaced-apart substantially parallel end edges, said band having a thickness many times smaller than the length and width thereof, said band having an inner surface which is in firm contact with the arm of the person in the area of the wrist and above the hand when said device is in use and an oppositely-directed outer surface;

(b) a weight of sufficient magnitude so as to improve the arm action of the person by enhancing the arm motion, causing fuller extension of the arm and providing control of arm movement, said weight comprising a closely packed quantity of metal pellets;

(c) means for holding said weight on said outer surface of said band in fixed relation thereto, said holding means comprising a first container of flexible material having a generally rectangular perimeter and enclosing said quantity of pellets, said container being of relatively thin-walled construction, a second container of flexible material having a generally rectangular perimeter and enclosing said first container, said containers being in relatively close-fitting relation, said second container having a thickness greater than the thickness of said first container, said second container being disposed on said outer surface of said band with the edges of said container being substantially parallel to neighboring edges of said band, and means for securing said second container to said band along the two opposite edges of said second container disposed generally parallel to said side edges of said band;

(d) a pair of loops fixed to said band in spaced-apart relation along one of said end edges;

(e) a pair of straps of flexible material, each fixed at one end thereof to said band in spaced-apart relation along the other of said end edges, said straps extending outwardly from said end edge in generally parallel relation to said side edges;

(f) fastening means on each of said straps, each of said fastening means being on the surface of the corresponding one of said straps which faces in the same direction as said outer surface of said band when said band and said strap lie in substantially the same plane;

(g) mating fastening means on said outer surface of said band in general longitudinal alignment with said fastening means on said straps; and (h) each of said straps extending from said end edge of said band along the surface of the person's arm and laterally of the arm and further extending through the corresponding one of said loops and then returning back past said end edge to the region of the corresponding one of said mating fastening means whereby each strap draws said band tightly against the surface of the person's arm and is held firmly in place by engagement between the fastening means on said strap and the corresponding one of said mating fastening means.

4. A device for improving the motion, extension and control of the arm of a person playing a game such as bowling comprising:

(a) a band of flexible material having a generally rectangular shape including spaced-apart substantially parallel side edges and spaced-apart substantially parallel end edges, said band having a thickness many times smaller than the length and width thereof, said band having an inner surface which is in firm contact with the arm of the person in the area of the wrist and above the hand when said device is in use and an oppositely-directed outer surface;

(b) a weight of sufficient magnitude so as to improve the arm action of the person by enhancing the arm motion, causing fuller extension of the arm and providing control of arm movements;

(c) means for holding said weight on said outer surface of said band in fixed relation thereto;

(d) a pair of loops fixed to said band in spaced-apart relation along one of said end edges;

(e) a pair of straps of flexible material, each fixed at one end thereof to said band in spaced-apart relation along the other of said end edges, said straps extending outwardly from said end edge in generally parallel relation to said side edges;

(f) fastening means on each of said straps, each of sad fastening means being on the surface of the corresponding one of said straps which faces in the same direction as said outer surface of said band when said band and said strap lie in substantially the same plane;

(g) mating fastening means on said outer surface of said band in general longitudinal alignment with said fastening means on said straps;

(h) each of said straps extending from said end edge of said band along the surface of the person's arm and laterally of the arm and further extending through the corresponding one of said loops and then returning back past said end edge to the region of the corresponding one of said mating fastening means whereby each strap draws said band tightly against the surface of the person's arm and is held firmly in place by engagement between the fastening means on said strap and the corresponding one of said mating fastening means; and (i) a pair of elongated stiffening elements, each of said stiffening elements being fixed to said band adjacent to and generally parallel with a corresponding one of said end edges.

5. A device according to claim 3 or 4, wherein said straps, loops and mating fastening means are located adjacent corresponding ones of said side edges of said band.

6. A device according to claim 3 or 4, wherein said straps are of unequal lengths, the one of said straps being located farthest from the person's hand having the greater length.

7. A device according to claim 3 or 4, wherein said fastening means on said straps and said mating fastening means on said band comprise plastic hook and loop tape type fasteners.

* * * * *